United States Patent [19]

Hänni et al.

[11] Patent Number: 4,700,599

[45] Date of Patent: Oct. 20, 1987

[54] APPARATUS FOR REMOVING AND STACKING OF SHEET METAL STRIPS CUT BY A PLATE SHEAR

[75] Inventors: Eduard Hänni, Zofingen; Markus Zweili, Basel, both of Switzerland

[73] Assignee: Hammerle AG, Zofingen, Switzerland

[21] Appl. No.: 883,855

[22] Filed: Jul. 10, 1986

Related U.S. Application Data

[63] Continuation of Ser. No. 696,317, Jan. 30, 1985, abandoned.

[30] Foreign Application Priority Data

Jan. 30, 1984 [AT] Austria ..... 295/84

[51] Int. Cl.[4] ..... B21D 43/22

[52] U.S. Cl. ..... 83/94; 414/82

[58] Field of Search ..... 83/94; 414/76, 82

[56] References Cited

U.S. PATENT DOCUMENTS

| | | | |
|---|---|---|---|
| 2,072,667 | 3/1937 | Coe | 414/82 |
| 2,928,559 | 3/1960 | Mosely | 414/82 X |
| 3,108,509 | 10/1963 | Felix | 83/94 X |
| 4,043,459 | 8/1977 | Moreau | 414/82 X |

*Primary Examiner*—Frank T. Yost

*Attorney, Agent, or Firm*—Karl F. Ross; Herbert Dubno

[57] ABSTRACT

An apparatus for removing strips from immediately downstream of the blades of a plate shear and stacking them on a pile at a predetermined position also downstream of the plate shear comprises a conveyor that moves the cut strip from the plate shear in the transport direction, a supporting rake downstream of the conveyor and movable horizontally at the same height as the conveyor between a receiving position directly above the pile position and an unloading position offset therefrom, a stripper above and cooperating with the supporting rake and engageable horizontally opposite to the direction with a strip on the rake, and an accelerator upstream of the stripper arrangement and engageable in the direction with a strip on the rake. The accelerator and the stripper can be locked at a predetermined spacing from each other in the direction for clasping the cut strip between the accelerator and the stripper arrangement. The accelerator and the stripper arrangement are moved together with the clasped cut strip and the supporting rake toward the pile and are retained together with the cut strip against horizontal movement above the pile and then the supporting rake is moved out from underneath the cut and clasped strip to the unloading position to stack it on the pile.

8 Claims, 10 Drawing Figures

APPARATUS FOR REMOVING AND STACKING OF SHEET METAL STRIPS CUT BY A PLATE SHEAR

This is a continuation of co-pending application Ser. No. 696,317 filed on Jan. 30, 1985, now abandoned.

FIELD OF THE INVENTION

The present invention refers to sheet-metal cutting apparatus and more particularly to an apparatus arranged behind the blades of a plate shear used for cutting sheet metal strips or sections from a sheet metal plate to remove these strips from the place behind the blades of the plate shear and to stack these strips on piles at a predetermined location behind the plate shear.

BACKGROUND OF THE INVENTION

There are already known mechanisms, by means of which various stacks, for example arranged according to the plate strip size, can be handled immediately in succession. Already known in the art is a plate shear with a supporting device, which is displaceable beyond the stacking places into a release position. A stop member is displaceable synchronously with the movement of said supporting device. A further development of this arrangement comprises a supporting member with a carrier member which acts under the influence of a control means. The plate strip, cut to size, is received by the supporting rake, and during the subsequent horizontal movement the supporting rake together with the plate strip and stop member is accelerated. At the same time, the plate strip slides on the supporting rake until the rear plate edge comes up against the carrier member. The carrier member, which has meanwhile moved out of the effective range of the control means, falls down as a result of its own weight, but is caught by means of the upper bent hook end on the edge of the plate strip inserted under it and carries the plate strip along with it. Shortly before the stop member has reached the stacking place intended for the plate strip, a deceleration occurs, and during this deceleration, the supporting member and the stop member are decelerated in such a way that the plate strip on the supporting member executes a relative movement towards the stop. The rear edge of the plate strip should thereby leave the upper bend hook end of the carrier member. Said carrier member falls down onto the stop in the supporting member as a result of its own weight and will assume the position of rest. The stop member remains at the predetermined position, whilst the supporting member continues its rearward movement, accelerates again, until it is retracted completely from the region of the stacking pile. The plate strip retained by the stationary stop member falls onto the stacking pile provided.

However, a disadvantage of this arrangement is that the supporting member first has to be accelerated, then decelerated in the region of the stacking pile and subsequently accelerated again. It is usually necessary for a pause to be included at the stacking point. A further disadvantage is that it is not possible to ensure that the hook-shaped end of the carrier member swings down perfectly, so that the plate strip is often not released by the carrier member and, during the further movement of the supporting member, the plate section clamped between the stop member and the carrier member is compressed. Finally, perfect centering of the plate stack cannot be achieved.

OBJECT OF THE INVENTION

The object of the invention is to provide an apparatus in which the supporting rake can be retracted at a constant speed, so that a speed deceleration and subsequent acceleration in the region of the stacking place no longer appear to be necessary. Furthermore, the plate section should be prevented from being compressed or otherwise damaged during transport to the stacking point. Finally, perfect centering of the plate sections should take place.

SUMMARY OF THE INVENTION

This object is accomplished by means of an apparatus which comprises:

- conveying means for moving the cut strip from the plate shear,
- a supporting rake arranged behind the conveying means and movable in horizontal direction at the same height as the conveying means,
- a stripper arrangement located above and cooperating with the supporting rake,
- an accelerator, arranged in the front of the stripper arrangement, the distance between the accelerator and the stripper arrangement being adjustable and fixable,
- connection means for locking the accelerator and the stripper arrangement at a predetermined spacing in order to clasp the cut strip arranged between said accelerator and the stripper arrangement,
- displacing means for displacing the accelerator and the stripper arrangement together with the cut strip and the supporting rake in the directio of the pile, and for
- retaining the accelerator and the stripper together with the out strip above the pile and displacing the supporting rake to a position which clears the stacking position in order to stack the cut strip on the pile,
- lateral centering stops movably arranged in the transverse direction and raisably located on both sides of the supporting rake.

The apparatus can be constructed so that the stripper and one accelerator comprise grasping members freely movably arranged in vertical direction between an upper and a lower end position, the path of the horizontally movable supporting rake being at such a distance underneath the accelerator and stripper that the grasping members assume a middle position during transport and pass to a lower end position in free fall in the stacking position above the pile.

The grasping members of the accelerator and of the stripper consist of cylindrical fingers which each have a damping device.

The accelerator is horizontally movably arranged on lateral guides and is connected to a drive rod extending parallel to the supporting and movable horizontally together with the accelerator.

The fingers of the accelerator and of the stripper, hanging down under their own weight, are combined into segments in retaining strips and are freely movable mounted in bores of a U-rail.

The stripper can comprise a clamping device in order to lock the drive rod guided by the clamping device and is connected to the accelerator. The U-rails with the fingers are fastened to two parallel vertical side plates which are horizontally displaceable guided by means of rollers. The cylindrical fingers can each be provided with a shock absorber in order to damp the impact of the metal strips and of the fingers on the stack.

BRIEF DESCRIPTION OF THE DRAWING

One embodiment of the apparatus will now be described in greater detail with reference to the accompanying drawing. In the drawing.

DESCRIPTION OF THE PREFERRED EMBODIMENT

Figure 1:
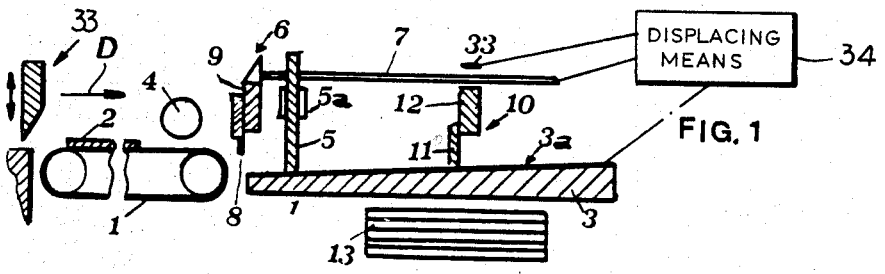
FIGS. 1 to 6 show, in a diagrammatic views the various working phases of an apparatus.

Referring now to the drawing the apparatus is arranged downstream in a normal transport direction D behind the blades of a plate shear 33 used for cutting sheet metal strips from a sheet metal plate. In FIG. 1, a conveyor belt 1 of the plate shear is shown only partially and serves to remove sheet metal strips 2 from the place behind the blades of the plate shear. The balance of the plate shear is not shown and is of conventional construction. The conveyor belt 1 conveys metal strips or sections 2 to a stacking place 13. The conveyor belt 1 is followed by a supporting rake 3 which has a surface *3a* rising relative to the horizontal for receiving the metal strip or section just conveyed. Located at the end of the conveyor belt 1, in the region of the corresponding end of the supporting rake 3, is a vertical adjustable driven roller The said roller 4 extends transversely over the conveyor belt 1 and conveys metal strips or sections 2 arriving on the conveyor belt 1 away from the conveyor belt onto the supporting rake 3. A lateral centering stop 5 is located on each of the two sides of the supporting rake 3, and these lateral stops 5 are movable relative to one another in the transverse direction and can also be raised an lowered. The lateral stops being driven, for example, via a hydraulic an oil motor *5a*, by means of which the distance between the two stops 5 can be reduced or increased. These stops 5 serve for the exact centering of the metal strips of sections 2 on the supporting rake 3. This ensures that all of the metal strips or sections 2 conveyed in succession always assume the same position on the supporting rake 3.

Located above the supporting rake 3 is an accelerator 6 which is movable horizontally by a diagrammatically illustrated displacing means 34 in the conveying direction D of the metal strips or sections 2 on lateral rails, not shown in any more detail, and which is connected to a drive rod 7 extending parallel to the supporting rake 3 and movable horizontally by the means 34, together with the accelerator 6, in suitable guides (not shown).

The accelerator 6 is provided with fingers 8 which extend vertically down and which are arranged so as to be vertically adjustable in a frame 9 of the accelerator. The arrangement is such that the fingers 8 can be lowered out of the position shown in FIG. 1 by hydraulic or pneumatic means, and the fingers 8 hang down under their own weight and can be moved freely to some extent in a guide.

At a certain distance from the accelerator 6, a stripper 10 is arranged so as to be movable horizontally along the drive rod 7 in the conveying direction D by the means 34. This stripper 10 is likewise provided with fingers 11 which are directed vertically and which are arranged so as to be freely movable in the vertical direction within certain limits in a frame 12 which can be raised and lowered vertically. The stripper 10 and the accelerator 6 will be described in more detail later with reference to FIGS. 7 to 9.

Figure 2:
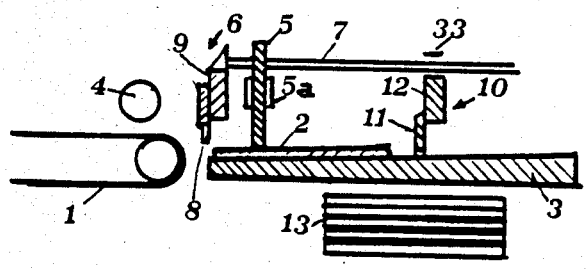
Figure 3:
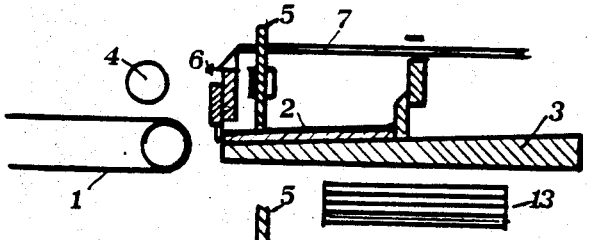
Figure 4:
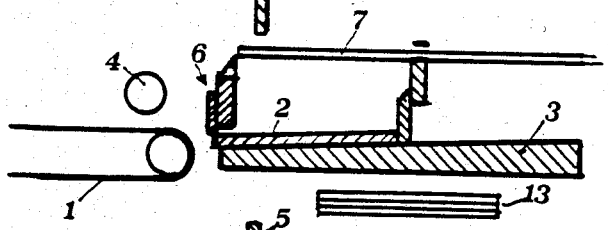

It is evident from the initial position shown in FIG. 1 that a metal strip or section 2 is still located at the end of the conveyor belt 1 and the accelerator 6 and stripper 10 are in the stand-by position. In this position, the fingers 8 are raised at a distance above the supporting rake 3, so that the metal strip 2 can be conveyed underneath the fingers 8 in the horizontal direction. In contrast to this, the fingers 11 of the stripper 10 engage between the prongs of the rake of the supporting rake 3. It is desired to bring the metal strip or section 2 onto the stack 13. The edge of the metal strip or section 2, which is the leading edge in the conveying direction, is located underneath the driven roller 4 which is lowered and which as a result of its rotation conveys the metal strip or section 2 onto the supporting rake 3. The latter assumes the position evident from FIG. 2. The transversely movable lateral stops 5 are now brought together, so that the metal strip 2 is centered exactly on the supporting rake 3. Subsequently, the fingers 8 of the accelerator 6 are lowered as a result of the lowering of the frame 9. The stripper 10 is moved by the means 34 in the opposite direction D to the conveying direction, that is to say from right to left in FIG. 2. In this way, the metal strip or section 2 is clamped between the fingers 8 of the stripper 10 and the fingers 11 of the accelerator 6, as is evident from FIG. 3. At the same time, further centering is carried out by the lateral stops 5, so that the metal strip or section assumes its final exactly centered position on the supporting rake 3. The lateral stops 5 are subsequently moved away sideways. To secure the clamped position of the metal strips or sections between the fingers 8 of the accelerator 6 and the fingers 11 of the stripper 10, the latter is retained relative to the drive rod 7. For this purpose, the stripper is provided with a gripping device 33 which, when actuated, makes a firm connection between the accelerator 6 and the stripper 10 by means of the rod 7. This position is evident from FIG. 4. The Figure shows that the stripper 10 is clamped on the drive rod 7, so that the distance between the stripper 10 and accelerator 6 cannot be changed.

Figure 5:
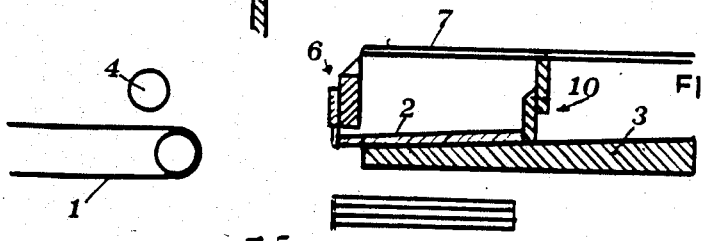
Figure 6:
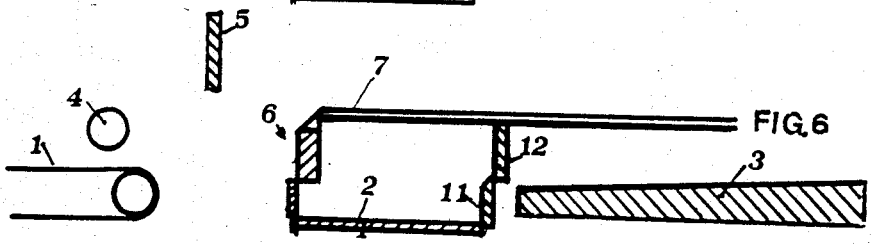

The entire mechanism, that is to say the supporting rake 3, the accelerator 6 and the stripper 10, together with the clamped metal strip or section 2, is now moved by the means 34 into the desired stacking position, to the right in FIG. 5. When this position above the stacking place 13 is reached, the accelerator 6 and the stripper 10 connected to it, together with the metal strip or section 2 clamped between them, are retained, while the supporting rake 3 is moved by the means 34 further into the end position at undiminished speed. After the supporting rake 3 has moved out of the position shown in FIG. 5 into the position shown in FIG. 6, the metal strip or section 2 lying on the rake 3 drops in free fall onto the stack 13 located underneath, as is evident from FIG. 6. However, the metal strip 2 is accompanied by the fingers 8 of the accelerator 6 and by the fingers 11 of the stripper 10 which, as mentioned, are held so as to be freely movable within specific limits in low-friction guides of the associated frames 9 and 12. The fingers 8 and 11 are first in their upper position and fall into their lower position after the supporting rake 3 has been removed. A precondition for this is that the horizontal path of the supporting rake 3 is at such a distance underneath the accelerator and the stripper that the fingers 8 and 11 assume their upper end position. This ensures that, during the falling movement, the plate section maintains its aligned position defined by the accelerator 6 and stripper 10 in the longitudinal direction and by the lateral stops 5 in the transverse direction, and assumes an exactly predetermined position on the stack 13.

Now that the basic design of a proposed apparatus and the mode of operation have been described in principle, its practical construction will be explained in more detail with reference to FIGS. 7 to 10. FIG. 7 again shows the conveyor belt 1 with the driven roller 4 which is located at the end of the conveyor belt and which is arranged by means of two lateral supports 4*a* on a beam 21 which can be raised and lowered. The roller 4 conveys the metal strip 2 onto the adjacent mechanism located behind the conveyor belt 1. This mechanism has the supporting rake 3 which is fastened, at its end facing away from the conveyor belt 1, so as to be movable in the horizontal direction. Of the two lateral stops, one lateral stop 5 can be seen in FIG. 7. These lateral stops are displaceable in guides 14 by means of rollers 14*a*, these guides 14 extending in the transverse direction. The lateral stops 5 have downwardly directed fingers 15 by means of which the metal strip is aligned. The movement of the lateral stops 5 is controlled by separate hydraulic motors 5*a*.

Figure 7:
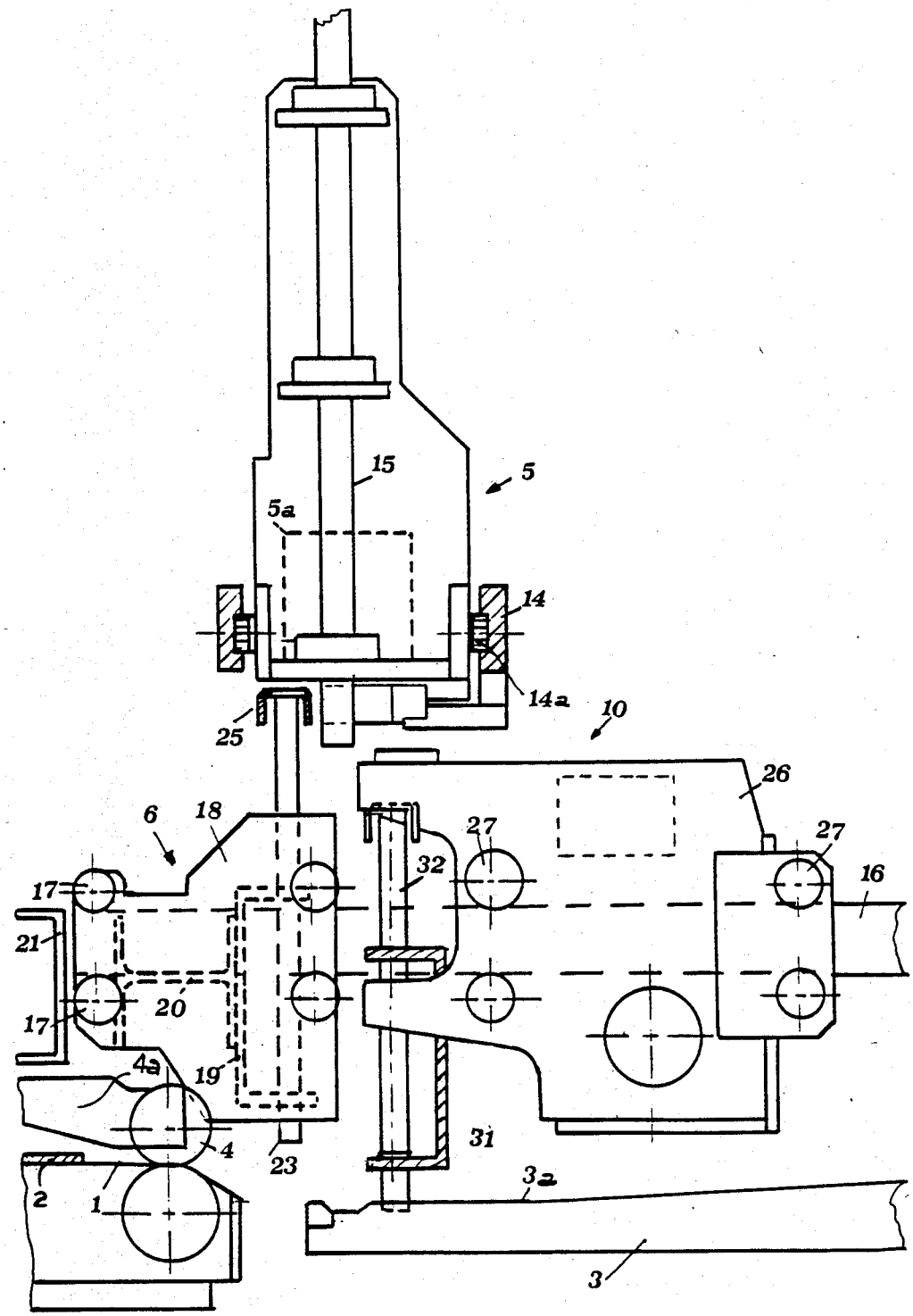
FIG. 7 shows, a preferred embodiment of the apparatus in side view.
Figure 8:
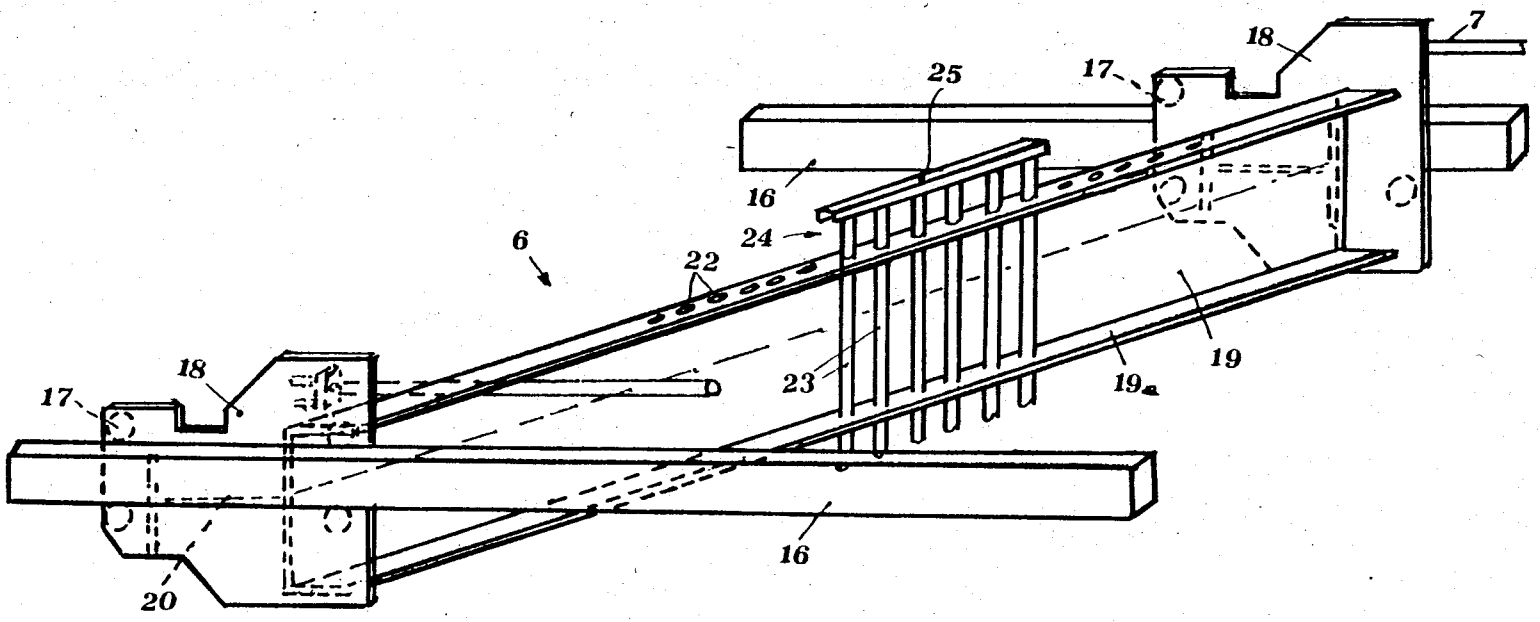
FIGS. 8 and 9 show respectively an accelerator and a stripper arrangement in perspective views.
Figure 9:
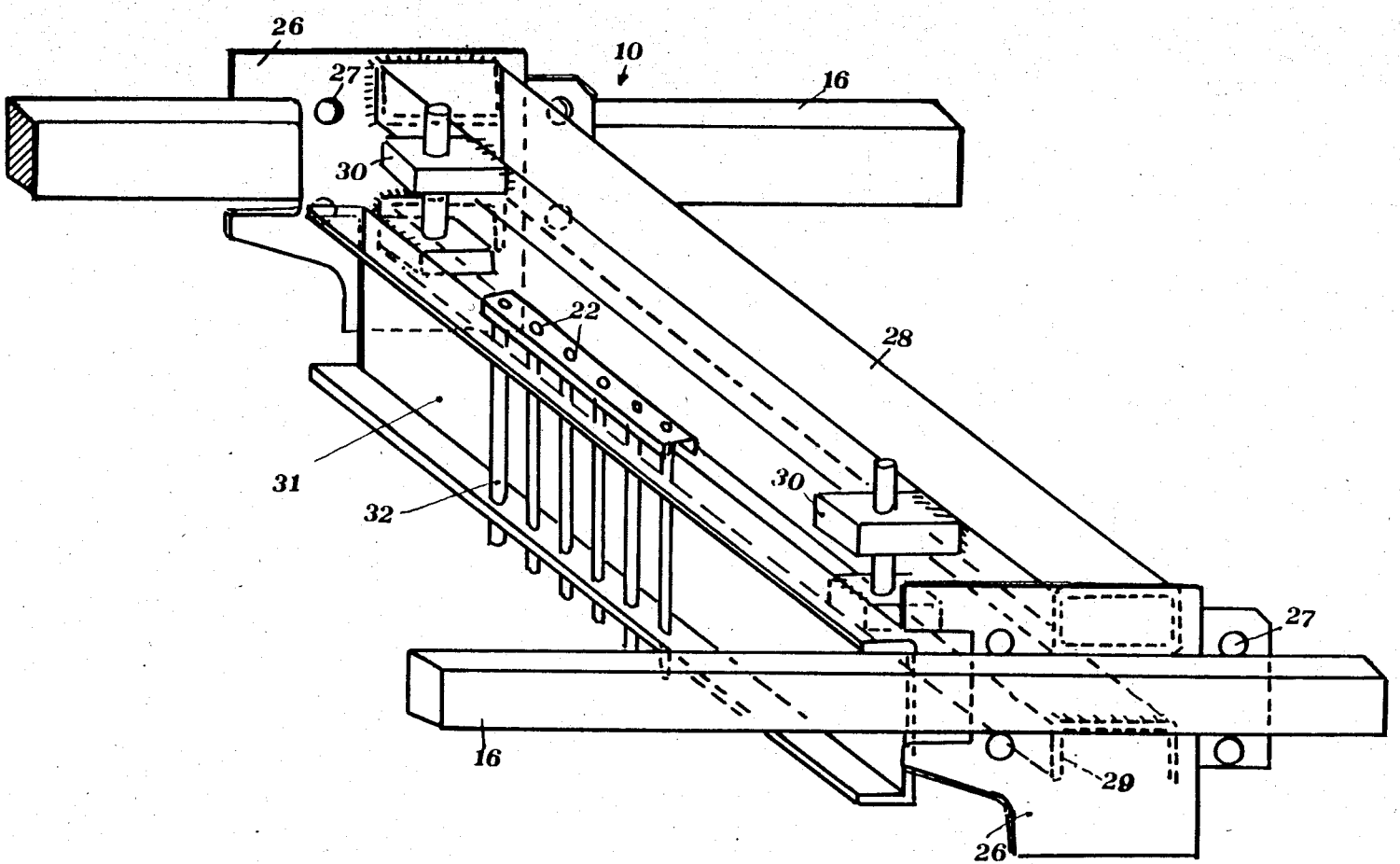

The accelerator 6 is designed as a slide and is movable along lateral guides 16 by means of guide rollers 17. arranged on a side plate 18, the side plates being connected by means of a U-rail 19 FIGS. 7 and 8).

The U-rail 19 is fastened to a T-rail 20 which extends between the two side plates 18 and which is fastened to these at both ends.

The horizontal flanges 19*a* of the U-rail 19 are provided with bores 22 which form guides for vertical and bar-shaped fingers 23 movable in these guides. Every six fiingers are combined into a segment 24, only one segment 24 being illustrated in FIG. 8. However, there are five segments 24 altogether. Retaining strips 25 equipped with bores are provided for forming the segments 24.

The fingers 23 can assume three positions, specifically a raise upper position, a middle position in which they rest on the rake-shaped plate support 3, and a lower position in which they deposit the plate section 2. Adjustment is carried out by pneumatic or hydraulic means known pér se.

The drive rod 7 described in conjunction with FIGS. 1 to 6 is also evident in FIG. 8. It leads to the stripper 10 which is shown in a view in FIG. 7 and diagrammatically in FIG. 9.

The stripper 10 is arranged on the two lateral guides 16 already mentioned and, in a similar way to the accelerator 6, has two side plates 26 which are each movable along the guides 16 by means of four rollers 27. The two side plates 26 are connected to one another by a beam 28 and by a U-beam 29. A U-rail 31 open horizontally toward the accelerator 6, is arranged on both of these by means of vertical adjustable guides 30. Accommodated in this U-rail 31, in a similar way to the U-rail 19 of the accelerator 6, are fingers 32 which are combined into segments and which can be brought into the desired position hydraulically or pneumatically by means of two cylinders. Since the rake-shaped plate support 3 has a certain gradient, this can be compensated by adjusting the guides 30.

FIG. 7 shows the accelerator 6 and the stripper 10 in the next possible position. In this position, the fingers 23 and 32 are at a distance suitable for receiving and aligning correspondingly small plate strips or sections. This distance can be increased as desired, as a result of the displacement of the stripper 10 along the guides 16, the greatest distance corresponding to the extent of the supporting rake 3. During use, the stripper 10 is set according to the width of the metal strip 2, so that the fingers 23 and 32 rest on the metal strip or section 2 and the position of the stripper 10 is maintained by means of a clamping device 33 which clamps the drive rod 7 guided by the clamping device.

Figure 10:
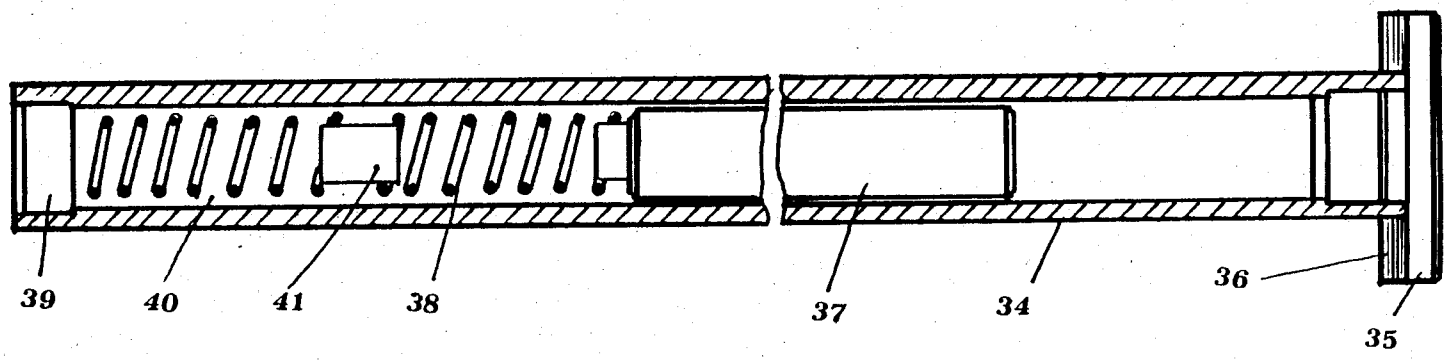
FIG. 10 shows a finger as a detail.

As already mentioned, in the middle position, the fingers 23 of the accelerator 6 or the fingers 32 of the stripper 10 rest on the supporting rake 3 and are supported so that, after the supporting rake 3 has been pulled away and when the metal strip or section 2 falls down onto the stack 13, the fingers 23 or 32 corresponding to fingers 8 and 11 can move in free fall in their guide bores 22, until the remaining strip 25 strikes against the U-rail 19. To damp the impact and prevent the fingers 23 or 32 from springing back, they are designed as shock-absorbers, as illustrated in FIG. 10. Each finger 23 or 32 consists of a cylindrical hollow body 34 provided at the top end with a stop head 35 which has a damping ring 36. Located inside the hollow body 34 is a damping piston 37 equipped with a helical spring 38. This is supported against a cylindrical closure 39 which closes off the interior 40 of the hollow body 34. An inertia body 41 is also located in the space 40 filled with oil. When the closure side 39 strikes against a fixed base, the impact is absorbed by the piston 37 and by the inertia body 41 so that the fingers 23 or 32 cannot spring back.

According to an alternative design, the fingers 23 or 32 can rest against the plate edge and cannot move in free fall, but are controlled electronically.

It should be pointed out tht the distance between the two parts 6 and 10 can be adjusted as desired. When the clamping device 33 is actuated, the stripper 10 is locked on the rod 7. The accelerator 6 and the stripper 10 can be driven by means of a rack, with which corresponding drive pinions of the accelerator 6 and of the stripper 10 mesh.

The mode of operation of the mechanism has already been described. It only remains to point out that the possibility of a rigid connection between the accelerator 6 and the stripper 10 prevents with absolute reliability a clamped plate section from being compressed or otherwise damaged as a result of incorrect manipulation. A further advantage is that the plate sections are aligned by the lateral stops, specifically even on the suporting rake 3 and not just on the stack, and the special design and arrangement of the fingers 23 and 32 ensure that the aligned position is maintained during the stacking operation.

The lateral stops 5 do not have to be movable in the longitudinal direction, thus ensuring a simpler construction. In contrast to this, alignment on the stack 13 would present difficulties, since, in this case, the lateral stops would also have to be movable in the longitudinal direction, thus making the constructive design substantially more expensive and more difficult.

Finally, the major advantage which should be mentioned is to be seen in the fact that the supporting rake 3 can be controlled in a very simple way, since it does nnot have to be braked at the stacking place and subsequently accelerated again. On the contrary, it is sufficient to accelerate the supporting rake 3 once only, and this then passes through the stack 13 at undiminished speed, the metal strip or section 2 carried with it being at the same time stripped off and deposited accurately on the stack.

What we claim is:

1. An apparatus downstream relative to a normal transport direction from the blades of a plate shear used for cutting sheet metal strips from a sheet metal plate to remove these strips from immediately downstream of the blades of the plate shear and to stack these strips on a pile at a predetermined position also downstream of the plate shear, the apparatus comprising:

conveying means for moving the cut strip from said plate shear in said transport direction, a supporting rake arranged downstream of said conveying means and movable horizontally at the same height as said conveying means between a receiving position directly above the pile position and an unloading position offset therefrom, a stripper arrangement located above and cooperating with said supporting rake and engageable horizontally opposite to said transport direction with a strip on the rake, An accelerator upstream of said stripper arrangement and engageable in said transport direction with a strip on the rake, the distance in the transport direction between said accelerator and said stripper being adjustable and fixable, Connnection means for locking said accelerator and said stripper arrangement at a predetermined spacing in said transport direction for clasping the cut strip between said accelerator and said stripper arrangement, displacing means for displacing said accelerator and said stripper arrangement together with the clasped cut strip and said supporting rake toward said pile and for retaining said accelerator and said stripper together with said cut strip against horizontal movement above said pile and displacing said supporting rake out from underneath the cut and clasped strip to the unloading position in order to stack said cut and clasped strip on said pile, and lateral centering stops movably arranged in the transverse direction on both sides of said supporting rake.

2. An apparatus as claimed in claim 1, wherein said stripper and said accelerator comprise grasping members freely movably arranged in a vertical direction between an upper and a lower end position, the path of said horizontally movable supporting rake being at such a distance underneath the accelerator and stripper that the grasping members assume a middle position during transport and pass to a lower end position in free fall in the stacking position above said pile.

3. An apparatus as claimed in claim 2, wherein the grasping members of the accelerator and of the stripper consists cylindrical fingers which each have a damping device.

4. An apparatus as claimed in claim 3, wherein the accelerator is horizontally movably arranged on lateral guides and is connected to a drive rod extending parallel to the supporting and movable horizontally together with the accelerator.

5. An apparatus as claimed in claim 4, wherein the fingers of the accelerator and of the stripper, hanging down under their own weight, are combined into segments in retaining strips and are freely movable mounted in bores of a U-rail.

6. An apparatus as claimed in claim 5, wherein the stripper comprises a clamping device in order to lock the drive rod guided by the clamping device and connected to the accelerator.

7. An apparatus as claimed in claim 6, wherein the U-rails with the fingers are fastened to two parallel vertical side plates which are horizontally displaceable guided by means of rollers.

8. An apparatus as claimed in claim 7, wherein the cylindrical fingers are each provided with a shock absorber in order to damp the impact of said metal strips and of said fingers on the stack.

* * * * *

UNITED STATES PATENT AND TRADEMARK OFFICE

CERTIFICATE OF CORRECTION

PATENT NO. : 4 700 599

DATED : 20 October 1987

INVENTOR(S) : Eduard HÄNNI et al.

It is certified that error appears in the above-identified patent and that said Letters Patent is hereby corrected as shown below:

Title Page, left column, for the names of inventors read:

-- [75] Inventors: Eduard HÄNNI, Zofingen; Urs WÄLCHLI, Oberentfelden, both of Switzerland--.

Signed and Sealed this

Third Day of May, 1988

*Attest:*

*Attesting Officer*

DONALD J. QUIGG

*Commissioner of Patents and Trademarks*